US011606989B2

(12) United States Patent
Dickerson et al.

(10) Patent No.: US 11,606,989 B2
(45) **Date of Patent: *Mar. 21, 2023**

(54) TOUCH PROTECTOR

(71) Applicant: NO-KNOB, LLC, West Bloomfield, MI (US)

(72) Inventors: Anne Govan Dickerson, Sag Harbor, NY (US); Sorcha Anne Sayers Bartlett, Grand Rapids, MI (US)

(73) Assignee: NO-KNOB, LLC, West Bloomfield, MI (US)

( * ) Notice: Subject to any disclaimer, the term of this patent is extended or adjusted under 35 U.S.C. 154(b) by 170 days.

This patent is subject to a terminal disclaimer.

(21) Appl. No.: 17/147,933

(22) Filed: Jan. 13, 2021

(65) Prior Publication Data

US 2021/0282474 A1 Sep. 16, 2021

Related U.S. Application Data

(60) Provisional application No. 62/988,523, filed on Mar. 12, 2020.

(51) Int. Cl.
*A41D 19/01* (2006.01)
*A41D 13/08* (2006.01)

(52) U.S. Cl.
CPC ..... *A41D 19/01* (2013.01); *A41D 13/087* (2013.01)

(58) Field of Classification Search
CPC ..... A41D 19/01; A41D 13/087
See application file for complete search history.

(56) References Cited

U.S. PATENT DOCUMENTS 342,341 A * 5/1886 Edwards ..... A61F 13/105 2/21
645,550 A * 3/1900 Clark ..... A47J 17/02 2/21
1,235,199 A * 7/1917 Gavin ..... A41D 13/087 2/21
1,990,553 A * 2/1935 Hirsch ..... A41D 13/087 294/25

(Continued)

OTHER PUBLICATIONS

Hippo Frog Shape Silicone Insulated Gloves Oven Mitt Heat Resistant; Light in the box; pp. 1-4; Retrieved May 12, 2020, from https://www.lightinthebox.com/en/p/kitchen-tools-silicone-kitchen-tools-accessories-heat-insulated-gloves-cooking-utenils-1pc_p6826358.html?currency=USD&litb_from=paid_adwords_shopping&sku=1_6916&country_code=us&utm_source=google_shopping&utm_medium=cpc&adword_mt=&adword_ct=348172038144&adword_kw=&adword _pos=adword_pl=&adword_net=u&adword_tar=&adw_src_id=2907233386_1900087675_72175872884_pla-613284782325&gclid=CjwKCAjwv4_1BRAhElwAtMDLsh2tCw-xJbQGgLGSWpPsFjz7lgwSyNBN019pwr_NnaYrx0TKEPiilxoCl18QAvD_BwE.

(Continued)

*Primary Examiner* — Khaled Annis
(74) *Attorney, Agent, or Firm* — Hauptman Ham, LLP

(57) ABSTRACT

An apparatus includes a first base portion coupled with a second base portion. The apparatus also includes a first backing member extending from the first base portion and a second backing member extending from the second base portion. A first length of the first base portion is equal to a second length of the second base portion and a first width of the first base portion is equal to a second width of the second base portion. A maximum distance between an outer surface of the first backing member and the first base portion is less than a maximum distance between an outer surface of the (Continued)

second backing member the second base portion such that a first space is less than a second space.

20 Claims, 6 Drawing Sheets

(56) References Cited

U.S. PATENT DOCUMENTS 2,041,262 A * 5/1936 Ness ..... A46B 5/04 601/139
2,840,950 A * 7/1958 Cotler ..... A63H 3/14 446/329
3,407,927 A * 10/1968 Jones ..... A47G 21/001 294/1.3
4,127,222 A * 11/1978 Adams ..... D05B 91/04 2/21
4,751,747 A * 6/1988 Banks ..... A41D 13/087 2/21
5,234,142 A * 8/1993 Loewen ..... A41D 13/087 2/21
5,280,661 A * 1/1994 Brown ..... A47L 13/18 15/214
5,282,276 A * 2/1994 Preiose ..... A45D 29/00 132/73
5,359,840 A * 11/1994 Costar ..... A01D 51/00 294/50.8
D368,330 S * 3/1996 Robinson ..... D29/119
5,688,181 A * 11/1997 Albert ..... A63B 21/4019 2/21
5,749,097 A * 5/1998 Garrett-Roe ..... A41D 19/0062 2/21
5,848,928 A * 12/1998 Wong ..... A63H 3/14 294/1.3
6,012,165 A * 1/2000 Cain ..... A41D 13/087 2/21
D425,261 S * 5/2000 Basile ..... D29/118
6,145,128 A * 11/2000 Suzuki ..... A41D 13/087 2/21
6,409,059 B1 6/2002 Calvert
D634,898 S * 3/2011 Lion ..... D29/119
8,943,612 B2 * 2/2015 Jeong ..... A41D 19/0055 2/21
9,033,383 B2 * 5/2015 Rampersad ..... A47J 43/283 294/25
D831,896 S * 10/2018 Krahe ..... D29/114
10,133,350 B1 * 11/2018 Graham ..... A41D 13/087
10,517,440 B2 * 12/2019 Leibovitch ..... A47J 43/25
10,918,146 B1 * 2/2021 Dickerson ..... A41D 19/01
2003/0131393 A1 * 7/2003 Votolato ..... A41D 13/081 2/16
2005/0108802 A1 * 5/2005 Burnett ..... A41D 13/087 2/16
2005/0160512 A1 * 7/2005 DeYoung ..... A41D 13/087 2/21
2007/0210596 A1 * 9/2007 Stewart ..... A47G 21/10 294/99.2
2008/0018123 A1 * 1/2008 Cox ..... B42D 9/04 2/21
2008/0066210 A1 3/2008 Berry et al.
2009/0100562 A1 * 4/2009 Liang ..... A41D 19/01 2/158
2012/0278964 A1 * 11/2012 Bormann-Early ... A41D 13/087 2/21
2013/0007987 A1 1/2013 Kleindorfer et al.
2013/0061364 A1 * 3/2013 Robb ..... A41D 13/087 2/21
2014/0068828 A1 * 3/2014 Holmes ..... A41D 13/087 2/21
2014/0078118 A1 * 3/2014 Robb ..... A41D 13/087 345/179
2014/0245517 A1 * 9/2014 Henry ..... A41D 19/01529 2/16
2014/0331377 A1 * 11/2014 Taylor-Lopez ..... A41D 13/087 2/21
2015/0272239 A1 * 10/2015 Bazley ..... A41D 13/0562 2/21
2017/0215494 A1 * 8/2017 Savides ..... A47J 17/10
2018/0008071 A1 * 1/2018 Jeong ..... A41D 13/087
2018/0168248 A1 6/2018 Cicco et al.
2018/0199643 A1 * 7/2018 Walker ..... A41D 19/0062
2019/0142192 A1 * 5/2019 Rampersd ..... A47G 21/001 294/99.2

OTHER PUBLICATIONS

Silicone Oven Mitt—Made by Design™; Target / Kitchen & Dining / Kitchen & Table Linens / Oven Mitts & Potholders; pp. 1-14; Retrieved May 12, 2020, from https://www.target.com/p/silicone-oven-mitt-made-by-design-8482/-/A-53226486.

Ninja Silicone Mitts, AMC108; Target / Kitchen & Dining / Kitchen & Table Linens / Oven Mitts & Potholders; pp. 1-8; Retrieved May 12, 2020, from https://www.target.com/p/ninja-silicone-mitts-amc108/-/A-54604941?ref=tgt_sdv_XS000000&AFID=google_pla_df&fndsrc=tgtao&CPNG=PLA_Appliances 2BShopping&adgroup=SC_Appliances_Keurig&LID= 700000001170770pgs&network=g&device=c&location=9017518&ds_rl=1246978&ds_rl=1247068&ds_rl=1248099&gclid=CjwKCAjwv4_BRAhEiwAtMDLskPNnbQXeA5JSlxmxn9EfGDzPGmeQz3s2VSVVUEPAPW_Hu-u-n7UgBoCM8MQAvD_BwE&gclsrc=aw.ds.

BergHOFF Silicene 2Pc Pot Holder Set; Target / Kitchen & Dining / Kitchen & Table Linens / Oven Mitts & Potholders; pp. 1-8; Retrieved May 12, 2020, from https://www.target.com/p/berghoff-silicone-2pc-pot-holder-set/-/A-79430538.

2 Pack Silcone Oven Gloves Heat Resistant Mini Mitt Pot Holder Cooking BBQ; Walmart.com; pp. 1-6; Retrieved May 12, 2020, from https://www.walmart.com/ip/2-Pack-Silicone-Oven-Gloves-Heat-Resistant-Mini-Mitt-Pot-Holder-Cooking-BBQ/331816754?wmlspartner=wlpa&selectedSellerId=13344&adid=22222222227000000000&wl0=&wl1=g&wl2=c&wl3=42423897272&wl4=aud-834279576166:pla-51320962143&wl5=9017518&wl6=wl7=&wl8=&wl9=pla&wl10=127117893&wl11=online&wl12=331816754&veh=sem&gclid=CjwKCAjwv4_1BRAhEiwAtMDLsqm0PWrx41eFkFExggCDDGBJAusOSmq47TwO1xR69ZAp189kxAL_fxoCkSQOAvD_BwE.

Dexas Siicone Micromitt™ 2-Pack; Kitch'n; Home / Tableware; Retrieved May 12, 2020, from https://www.kitchn.shop/products/dexas-silicone-micromitt-2-pack.html?gclid=CjwKCAjwv4_1BRAhElwAtMDLskY_64dLk1sqzocOF-mKHN0oCWgemiC9ft551 uqW90pccbSrTVku8xoCC90QAvD_BwE.

Urban Trend® Finger Armor Cutting Guard; Kitch'n; Home / Knives; Retrieved May 12, 2020, from https://www.kitchn.shop/products/urban-trend-finger-armor-cutting-guard.html?gclid=CjwKCAjwv4_1BRAhEiwAtMDLsu1wiFOcTd5u4LWfkYY_rRz7kl_-lNPnwtAidlnYpxXu3GLIRPO78BoCP-sQAvD_BwE.

The Extended European Search Report issued in corresponding European Application No. 21162357.4, dated Nov. 11, 2021, pp. 1-10, European Patent Office, Munich, Germany.

* cited by examiner

TOUCH PROTECTOR

PRIORITY

The present application claims priority to U.S. Provisional Patent Application No. 62/988,523, filed Mar. 12, 2020, which is incorporated by reference herein in its entirety.

BACKGROUND

People often grab, or at least touch, doorknobs, door handles, doors, windows, or surfaces when opening or closing doors. People also grab or at least touch objects or one or more surfaces of an object when picking up or otherwise moving an object. Touching unsanitary doorknobs, door handles, doors, windows, objects, surfaces, and the like can lead to the spread of disease, illness and/or infection.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
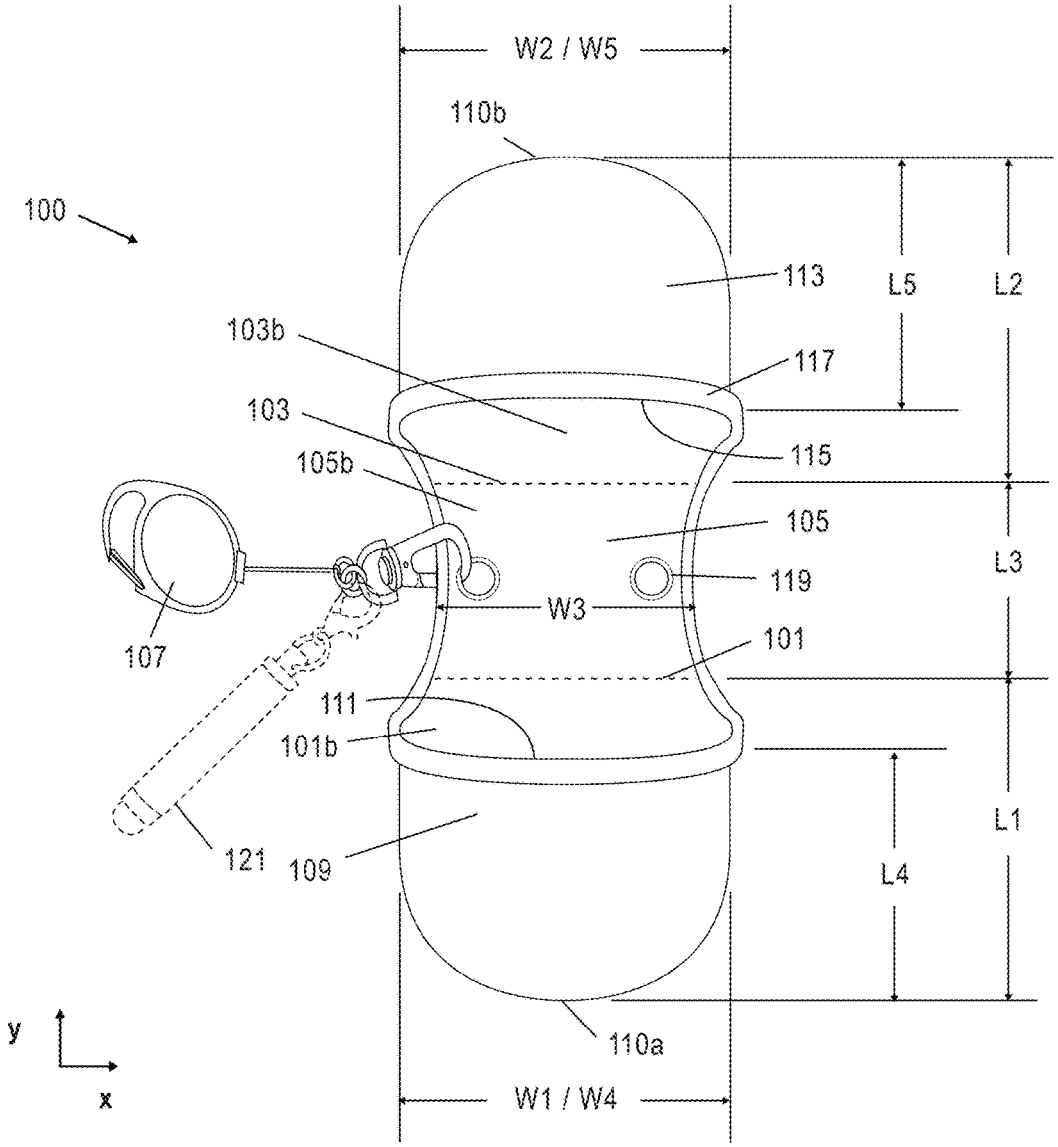
FIG. 1 is a top-side view of a touch protector in an open position, in accordance with one or more embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

People often grab, or at least touch, doorknobs, door handles, doors, windows, or surfaces when opening or closing doors. People also grab or at least touch objects or one or more surfaces of an object when picking up or otherwise moving an object. Touching unsanitary doorknobs, door handles, doors, windows, objects, surfaces, and the like can lead to the spread of disease, illness and/or infection.

People sometimes attempt to avoid touching doorknobs, door handles, doors, windows, objects, surfaces, and the like with one's hands or fingers by using an elbow, knee, foot, shoulder, back, glove, etc. But, practices such as these may put a person in an uncomfortable or unsafe position and may also lead to unintended touching of a contaminated body part, clothing or glove by a person's hand or fingers without first sanitizing the contaminated body part, clothing or glove, for example.

The discussed embodiments are directed to a touch protector that provides a sanitary way to one or more of open doors, hold open doors, push or pull door handles, push or pull doorknobs, twist doorknobs, push elevator buttons, open windows, pick up or move objects, actuate touchpads, interact with touchscreens, etc. while avoiding direct contact with one's hands and fingers. By avoiding direct contact between one's hands and fingers and a potentially contaminated surface, the opportunity for a person to inadvertently cause skin to skin contact between a hand or finger that has contacted a potentially contaminated surface and one's face, eyes, nose, mouth, open wound, or other body part, and/or the face, eyes, nose, mouth, open wound, or other body part of another person can be minimized.

Minimizing skin to skin contact between a hand or finger that has contacted a potentially contaminated surface and one's face, eyes, nose, mouth, open wound, or other body part, and/or the face, eyes, nose, mouth, open wound, or other body part of another person helps to prevent the spread of disease, illness or infection caused by germs, bacteria, fungi, viruses, protozoa, other microbes or microorganisms, parasites, insects, etc.

Minimizing skin to skin contact between a hand or finger that has contacted a potentially contaminated surface and one's face, eyes, nose, mouth, open wound, or other body part, and/or the face, eyes, nose, mouth, open wound, or other body part of another person also helps to reduce a person's fear or anxiety that may be associated with the opportunity to contract a disease, illness or infection caused by germs, bacteria, fungi, viruses, protozoa, other microbes or microorganisms, parasites, insects, etc. by touching potentially contaminated items.

Furthermore, by avoiding direct contact between one's hands and fingers and a potentially contaminated surface, a person can avoid directly touching a dirty, greasy, or debris covered surface or object to help prevent dirt, grease, dust, debris, etc. from being transferred to other body parts or clothing of the person or others.

FIG. 1 is a top-side view of a touch protector 100 in an open position, in accordance with one or more embodiments. Touch protector 100 comprises a first base portion

101 having a first surface 101*a* (FIG. 3) and a second surface 101*b* opposite the first surface 101*a*, a second base portion 103 having a third surface 103*a* (FIG. 3) and a fourth surface 103*b* opposite the third surface 103*a*, a bridge portion 105 coupling the first base portion 101 and the second base portion 103. In some embodiments, the touch protector 100 is free from including the bridge portion 105, and the first base portion 101 is directly coupled with the second base portion 103.

Bridge portion 105 has a fifth surface 105*a* (FIG. 3) and a sixth surface 105*b* opposite the fifth surface 105*a*. In some embodiments, the fifth surface 105*a* of the bridge portion 105 adjoins one or more of the first surface 101*a* of the first base portion 101 or the third surface 103*a* of the second base portion 103, and the sixth surface 105*b* of the bridge portion 105 adjoins one or more of the second surface 101*b* of the first base portion 101 or the fourth surface 103*b* of the second base portion 103.

Touch protector 100 includes an optional tether 107 one or more of extending from, or directly or indirectly coupled with, at least one of the first base portion 101, the second base portion 103, or the bridge portion 105. In some embodiments, touch protector 100 is free from having tether 107.

In some embodiments, one or more of the first surface 101*a*, the second surface 101*b*, the third surface 103*a*, the fourth surface 103*b*, the fifth surface 105*a* or the sixth surface 105*b* is textured. In some embodiments, one or more of the first surface 101*a*, the second surface 101*b*, the third surface 103*a*, the fourth surface 103*b*, the fifth surface 105*a* and the sixth surface 105*b* are smooth and free from texturing surface features.

Touch protector 100 comprises a first backing member 109 on a second surface 101*b* side of the first base portion 101. A structure formed by the first base portion 101 and the first backing member 109 has an end 110*a*. The first backing member 109 and the first base portion 101 are configured to have a first space 111 between the first backing member 109 and the first base portion 101. Touch protector 100 additionally comprises a second backing member 113 on a fourth surface 103*b* side of the second base portion 103. A structure formed by the second base portion 103 and the second backing member 113 has an end 110*b*. The second backing member 113 and the second base portion 103 are configured to have a second space 115 between the second backing member 113 and the second base portion 103. In some embodiments, the one or more of the first backing member 109 or the second backing member 113 forms a pocket with a corresponding first base portion 101 or second base portion 103. In some embodiments, the one or more of the first backing member 109 or the second backing member 113 comprises one or more of a loop, strap, flap, or other suitable structure that extend(s) from the corresponding first base portion 101 or second base portion 103.

In some embodiments, at least one of the first space 111 formed by the first backing member 109 and the first base portion 101 or the second space 115 formed by the second backing member 113 and the second base portion 103 is a cavity having one opening. In some embodiments, at least one of the first space 111 formed by the first backing member 109 and the first base portion 101 or the second space 115 formed by the second backing member 113 and the second base portion 103 is a cavity having more than one opening.

The first base portion 101 has a first mass, the second base portion 103 has a second mass, and the bridge portion 105 is configured to flex based on at least one of the first mass or the second mass such that the first base portion 101, the second base portion 103 and the bridge portion 105 together form a substantially U-shaped structure in a side view if the first base portion 101 is over the second base portion 103, if the second base portion 103 is over the first base portion 101, and/or if the bridge portion 105 is over the first base portion 101 and the second base portion 103.

In some embodiments, first base portion 101, the second base portion 103 and the bridge portion 105 together form a substantially U-shaped structure in a side view if the first base portion 101 is over the second base portion 103, if the second base portion 103 is over the first base portion 101, and/or if the bridge portion 105 is over the first base portion 101 and the second base portion 103, wherein the a spacing between the first base portion 101, the second base portion 103 and the bridge portion 105 is pie-shaped such that the first surface 101*a* of the first base portion 101 and the third surface 103*a* of the second base portion 103 are angled with respect to one another. In some embodiments, a gap between the bridge portion side of the first base portion 101 and the second base portion 103 is greater than a gap between the ends of the first base portion 101 and the second base portion 103 that are away from the bridge portion 105. In some embodiments, a gap between the bridge portion side of the first base portion 101 and the second base portion 103 exists and while the ends of the first base portion 101 and the second base portion 103 that are away from the bridge portion 105 are in direct physical contact with one another such that the spacing is pie-shaped between base portion 101, the second base portion 103 and the bridge portion 105.

In some embodiments, the bridge portion 105 is configured to prevent the first base portion 101 from being in direct physical contact with the second base portion 103 if the first base portion 101 is over the second base portion 103, if the second base portion 103 is over the first base portion 101, and/or if the bridge portion 105 is over the first base portion 101 and the second base portion 103.

In some embodiments, the bridge portion 105 is one or more of flexible or hinged to allow the first base portion 101 to be in direct physical contact with the second base portion 103 if the first base portion 101 is over the second base portion 103, if the second base portion 103 is over the first base portion 101, and/or if the bridge portion 105 is over the first base portion 101 and the second base portion 103.

In some embodiments, if the touch protector 100 is free from including the bridge portion 105, the structure formed by the first base portion 101 and the second base portion 103 is configured to fold such that the structure is substantially U-shaped and/or the spacing between the first base portion 101 and the second base portion 103 is pie-shaped, as discussed above. In some embodiments, if the touch protector 100 is free from including bridge portion 105, first base portion 101 and second base portion 103 contact one another if the first base portion 101 is over the second base portion 103, and/or if the second base portion 103 is over the first base portion 101.

In some embodiments, touch protector 100 is a mitt-like structure, with foldable sides that are capable of being held between one or more of a user's fingers and/or a user's thumb to facilitate the user's touching or grabbing of surfaces, objects, doorknobs, door handles, buttons, keypads, touchscreens, etc.

For example, if a user's thumb is inserted into the first space 111 and the user's forefinger, alone, or in combination with one or more of the user's other fingers, is inserted into the second space 115, when the user draws the thumb and one or more fingers together, the touch protector 100 is configured to contract with the user's movement such that the first surface 101*a* of the first base portion 101 is moved toward the third surface 103*a* of the second base portion 103. In some embodiments, touch protector 100 is capable of accommodating a user's thumb in one of the first space 111 or the second space 115 and one, two, three or four fingers in the other of the first space 111 or the second space 115. In some embodiments, touch protector 100 is configured to accommodate at least one finger in one of the first space 111 or the second space 115 and at least one other finger in the other of the first space 111 or the second space 115.

A first structure comprising the first base portion 101 and the first backing member 109 differs from a second structure comprising the second base portion 103 and the second backing member 113. For example, in some embodiments, a first structure comprising the first base portion 101 and the first backing member 109 is larger in at least one of a length direction, a width direction or a height direction compared to a second structure comprising the second base portion 103 and the second backing member 113 such that the larger structure is configured to accommodate two or more fingers and the smaller structure is configured to accommodate a thumb or lesser quantity of fingers compared to the larger structure.

The first base portion 101 comprises a first material, the second base portion 103 comprises a second material, the bridge portion 105 comprises a third material, the first backing member 109 comprises a fourth material, and the second backing member 113 comprises a fifth material.

In some embodiments, one or more of the first material, the second material, the third material, the fourth material or the fifth material comprises silicone. In some embodiments, one or more of the first material, the second material, the third material, the fourth material or the fifth material comprises one or more of silicone, rubber, silicone rubber, elastane, spandex, lycra, urethane, polyester, some other suitable polymer, or some other suitable material. In some embodiments, one or more of the first material, the second material, the third material, the fourth material or the fifth material further comprises one or more powders, microparticles, and/or nanoparticles mixed with the one or more of silicone, rubber, silicone rubber, elastane, spandex, lycra, urethane, polyester, other suitable polymer, or other suitable material. In some embodiments, one or more of the powders, microparticles and/or nanoparticles comprises a metal, carbon, carbon nanotubes, an oxide, or some other suitable material. In some embodiments, a metal powder comprises one or more of silver, tin, copper, nickel, indium, or some other suitable material. In some embodiments, one or more of the first material, the second material, the third material, the fourth material or the fifth material is anti-microbial. In some embodiments, one or more of the first material, the second material, the third material, the fourth material or the fifth material is capable of being readily sanitized, cleaned, and disinfected such that the touch protector is reusable.

In some embodiments, the first material, the second material, the third material, the fourth material and the fifth material are identical. In some embodiments, at least one of the first base portion 101, the second base portion 103, the bridge portion 105, the first backing member 109 or the second backing member 113 comprises a different material than at least one other of the first base portion 101, the second base portion 103, the bridge portion 105, the first backing member 109 or the second backing member 113.

In some embodiments, at least one of the second material, the third material, the fourth material or the fifth material is more flexible than the first material under a predetermined load at standard temperature and pressure. In some embodiments, at least one of the second material, the third material, the fourth material or the fifth material is less flexible than the first material under a predetermined load at standard temperature and pressure. In some embodiments, one or more of the first backing member 109 or the second backing member 113 comprises a different material than the first base portion 101 or the second base portion 103. In some embodiments, the first material and the second material are identical, and at least one of the fourth material or the fifth material is different from the first material and the second material. In some embodiments, the first material, the second material and the third material are identical, and at least one of the fourth material or the fifth material is different from the first material, the second material and the third material.

First base portion 101 has a length L1 in a first direction and a width W1 in a second direction orthogonal to the first direction. Second base portion 103 has a length L2 in the first direction and a width W2 in the second direction. Bridge portion 105 has a length L3 in the first direction and a width W3 in the second direction. First backing member 109 has a length L4 in the first direction extending from an end of the first backing member 109 to an upper edge of the first space 111 and a width W4 in the second direction. Second backing member 113 has a length L5 in the first direction extending from an end of the second backing member 113 to an upper edge of the second space 115 and a width W5 in the second direction.

In some embodiments, the length L1 and width W1 of the first base portion 101 are identical to the length L2 and width W2 of the second base portion 103. In some embodiments, if touch protector 100 includes a first base portion 101 and a second base portion 103 having equal lengths and widths, such a structure helps to minimize the opportunity for a user to contact a surface of the touch protector 100 such as first surface 101*a* of the first base portion 101 and/or third surface 103*a* of second base portion 103, and/or fifth surface 105*a* of the bridge portion 105 that has been used to contact a potentially contaminated or dirty surface. For example, minimizing contact between a hand or finger that has contacted a potentially contaminated surface and one's face, eyes, nose, mouth, open wound, or other body part, and/or the face, eyes, nose, mouth, open wound, or other body part of another person helps to prevent the spread of disease, illness or infection caused by germs, bacteria, fungi, viruses, protozoa, other microbes or microorganisms, parasites, insects, etc.

In some embodiments, one or more of the length L1 or width W1 of the first base portion 101 is different from the length L2 and width W2 of the second base portion 103. For example, in some embodiments, if touch protector 100 includes a first base portion 101 and a second base portion 103 having equal lengths and different widths, such a structure may help a user to push a button on a keypad or in an elevator using the portion of touch protector 100 having the narrower width.

In some embodiments, one or more of the length L3 and width W3 of the bridge portion 105 is different from at least one of the length L1 or the width W1 of the first base portion 101 or the length L2 or the width W2 of the second base portion 103. In some embodiments, a reduced length, width and/or thickness of the bridge portion 105 compared to the first base portion 101 and/or the second base portion 103 helps to enhance the flexibility/foldability of the touch protector 100, reduce material usage, weight and costs associated with manufacturing the touch protector 100.

In some embodiments, at least one of the length L4 and width W4 of the first backing member 109 or the length L5 and width W5 the second backing member 113 is identical to the length and width of the corresponding first base portion 101 or the second base portion 103. In some embodiments, at least one of the length L4 and width W4 of the first backing member 109 or the length L5 and width W5 the second backing member 113 is different from at least one of the length L1/L2 or the width W1/W2 of at least one of the first base portion 101 or the second base portion 103. In some embodiments, a reduced length, width and/or thickness of the first backing member 109 or the second backing member 113 compared to the first base portion 101 and/or the second base portion 103 helps to reduce material usage, weight and costs associated with manufacturing the touch protector 100.

In some embodiments, the length L1 of the first base portion 101 is equal to the length L2 of the second base portion 103, the width W1 of the first base portion 101 is equal to the width W2 of the second base portion 103, the length L4 of the first backing member 109 is equal to the length L5 of the second backing member 113, and the width W4 of the first backing member 109 is equal to the width W5 of the second backing member 113, but a maximum distance between an outer surface of the first backing member 109 and the second surface 101*b* of the first base portion 101 in a third direction perpendicular to the first direction and perpendicular to the second direction is less than a maximum distance between an outer surface of the second backing member 113 and the fourth surface 103*b* of the second base portion 103 in the third direction. In other words, a height of the first backing member 109 with respect to the first base portion 101 is less than a height of the second backing member 113 with respect to the second base portion 103 such that an interior height of the first space 111 is less than an interior height of the second space 115. As a result, the first space 111 is smaller than the second space 115 to facilitate a snug fitting of a user's thumb within first space 111. In some embodiments, an interior sidewall of the first backing member 109 is separated from an exterior of the first backing member 109 by a distance greater than a first backing member thickness of a majority of the first backing member, and a second backing member thickness of the second backing member 113 is less than the distance by which the interior sidewall of the first backing member 109 is separated from the exterior of the first backing member 109. In some embodiments, the separation is filled with extra material, a solid filler of extra material, one or more ribs, one or more additional sidewalls internal to the first backing member 109, or some other suitable structure to fill a void within the structure formed by first base portion 101 and first backing member 109 to facilitate a snug fitting of a user's thumb within first space 111. In some embodiments, the first backing member 109 comprises a first support structure extending along a first side of the first base portion 101 and a second support structure extending along a second side of the first base portion 101 opposite the first side of the first base portion 101, wherein the first support structure and the second support structure are portions of the first backing member 109 having thicknesses in the second direction greater than the first backing member thickness of the majority of the first backing member 109 such that an interior width of the first space 111 is less than an interior width of the second space 115 in the second direction to facilitate the snug fitting of a user's thumb within first space 111. In some embodiments, the first backing member 109 has an end thickness in the first direction less than the thicknesses of the first support structure and the second support structure in the second direction.

In some embodiments, one or more of the length L4 of the first backing member 109 is less than the length L1 of the or the length L5 of the second backing member 113 is less than length L2 of the second base portion 103 to minimize a length of the first space 111 and/or the second space 115 in the first direction and maximize an alignment between a user's knuckles and the edge of the first backing member 109 defining the first space 111 or the second backing member 113 defining the second space 115. In some embodiments, a user's tactile experience and ability to grasp a round object such as a doorknob is improved if a user's knuckles are substantially aligned with the of the first backing member 109 defining the first space 111 or the second backing member 113 defining the second space 115, and an amount of space within the first space 111 and/or the second space 115 is minimized, because the first base portion 101, second base portion 103 and bridge portion 105 are caused to flex in a manner that corresponds with a flexing of the user's hand based on the contact points between the user's hand and the first backing member 109 and/or the second backing member 113.

In some embodiments, the sides of the bridge portion 105 are curved inward, or are concave, with respect to an interior of the bridge portion 105. In some embodiments, the sides of the bridge portion 105 are straight between the first base portion 101 and the second base portion 103. In some embodiments, one or more of the first base portion 101, the second base portion 103, the first backing member 109 or the second backing member 113 have an edge that makes a smooth transition into a side of the bridge portion 105. In some embodiments, the smooth transition of one or more of the edges of the first base portion 101, the second base portion 103, the first backing member 109 or the second backing member 113 into a side of the bridge portion 105 causes the first space 111 or the second space 115 to be at least partially open and improves a user's comfortable use of the touch protector 100, and makes the touch protector easier to clean.

In some embodiments, the structure formed by at least the first base portion 101, second base portion 103, and bridge portion 105 is substantially hour-glass shaped in a top view in which the touch protector 100 is in an open-state. In some embodiments, the structure formed by at least the first base portion 101, second base portion 103, and bridge portion 105 is oval-shaped in a top view in which the touch protector 100 is in an open-state. In some embodiments, the structure formed by at least the first base portion 101, second base portion 103, and bridge portion 105 is rectangular in a top view in which the touch protector 100 is in an open-state. In some embodiments, the structure formed by at least the first base portion 101, second base portion 103, and bridge portion 105 is square in a top view in which the touch protector 100 is in an open-state. In some embodiments, the structure formed by at least the first base portion 101, second base portion 103, and bridge portion 105 is oblong in a top view in which the touch protector 100 is in an open-state. In some embodiments, the structure formed by at least the first base portion 101, second base portion 103, and bridge portion 105 is circular in a top view in which the touch protector 100 is in an open-state. In some embodiments, the structure formed by at least the first base portion 101, second base portion 103, and bridge portion 105 is some other suitable shape in a top view in which the touch protector 100 is in an open-state.

In some embodiments, the structure formed by at least the first base portion 101, second base portion 103, and bridge portion 105 is shaped to resemble an animal, a fictional character, or some other object to attract the attention of a user that might need to be induced to use the touch protector 100, such as a child. In some embodiments, the shape of the structure helps to make the touch protector 100 one or more of attractive, fashionable, fun and kid-friendly to help train and induce an adult or child user to use the touch protector 100.

In some embodiments, the structure formed by the first base portion 101 and the first backing member 109 has an end 110*a* that is curved in a top-side view with the touch protector 100 in an opened state. In some embodiments, the end 110*a* of the structure formed by the first base portion 101 and the first backing member 109 is squared off in a top-side view with the touch protector 100 in an opened state. In some embodiments, the structure formed by the second base portion 103 and the second backing member 113 has an end 110*b* that is curved in a top-side view with the touch protector 100 in an opened state. In some embodiments, the end 110*b* of the structure formed by the second base portion 103 and the second backing member 113 is squared off in a top-side view with the touch protector 100 in an opened state. In some embodiments, the shape of the end 110*a* of the structure formed by the first base portion 101 and the first backing member 109 is identical to the shape of the end 110*b* of the structure formed by the second base portion 103 and the second backing member 113. In some embodiments, the shape of the end 110*a* of the structure formed by the first base portion 101 and the first backing member 109 is different from the shape of the end 110*b* of the structure formed by the second base portion 103 and the second backing member 113. In some embodiments, one or more of the shape of the end 110*a* of the structure formed by the first base portion 101 and the first backing member 109 or the shape of the end 110*b* of the structure formed by the second base portion 103 and the second backing member 113 is pointed, hexagonal, octagonal, some other polygonal shape, multi-sectioned to facilitate separability between fingers, or some other suitable shape.

In some embodiments, the first base portion 101 has a first thickness in the third direction orthogonal to the first direction and the second direction, the second base portion 103 has a second thickness in the third direction, the bridge portion 105 has a third thickness in the third direction, the first backing member 109 has a fourth thickness in the third direction, and the second backing member 113 has a fifth thickness in the third direction.

At least one of the second base portion 103, the bridge portion 105, the first backing member 109 or the second backing member 113 is more flexible than the first base portion 101 under a predetermined load at standard temperature and pressure. In some embodiments, the second base portion 103, the bridge portion 105, the first backing member 109 or the second backing member 113 is less flexible than the first base portion 101 under a predetermined load at standard temperature and pressure.

In some embodiments, the first thickness, the second thickness, the third thickness, the fourth thickness and the fifth thickness are identical. In some embodiments, at least one of the second thickness, the third thickness, the fourth thickness or the fifth thickness is different from the first thickness.

The first backing member 109 is connected with the first base portion 101, and the first backing member 109 and the first base portion 101 are configured to form a first collapsible pocket that expands to a maximum size of the first space 111 based on a size of an object within the first collapsible pocket and retracts to a minimum size of the first space 111 based the object being removed from the first collapsible pocket. In some embodiments, the second backing member 113 is connected with the second base portion 103, and the second backing member 113 and the second base portion 103 are configured to form a collapsible pocket that expands to a maximum size of the second space 115 based on a size of an object within the second collapsible pocket and retracts to a minimum size of the second space 115 based the object being removed from the second collapsible pocket.

For example, if a user inserts a thumb into the first space 111 and a forefinger into the second space 115, the first collapsible pocket expands to accommodate the thumb and the second collapsible pocket expands to accommodate the forefinger. But, when the thumb and forefinger are removed from the first collapsible pocket and the second collapsible pocket, then the first backing member 109 contracts or falls toward the first base portion 101 and the second backing member 113 contracts or falls toward the second base portion 103.

In some embodiments, the capability for the expansion and contraction of the first collapsible pocket and the second collapsible pocket, and/or for the bridge portion 105 being configured to flex such that the first base portion 101, the second base portion 103 and the bridge portion 105 together form a substantially U-shaped structure, or other suitable shape, in a side view if the first base portion 101 is over the second base portion 103, if the second base portion 103 is over the first base portion 101, and/or if the bridge portion 105 is over the first base portion 101 and the second base portion 103 is a function of one or more of the thicknesses or the materials of the first base portion 101, second base portion 103, bridge portion 105, first backing member 109 and second backing member 113.

In some embodiments, one or more of the first space 111 or the second space 115 is always at least partially open when the touch protector 100 is hanging from a user's belt, bag, purse, briefcase, backpack, belt buckle, belt loop, pant leg, pocket, shirt, jacket, armband or other suitable location accessible to a user. In some embodiments, one or more of the first backing member 109 or the second backing member 113 forms a non-collapsible pocket with the first base portion 101 or the second base portion 103 such that the first space 111 and/or the second space 115 is substantially uniform in size and shape regardless of whether a user inserts a thumb or one or more fingers into the first space 111 or the second space 115. With one or more of the first space 111 or the second space 115 always at least partially open, the touch protector 100 allows for a user to easily slip a thumb and/or one or more fingers into the first space 111 or the second space 115 on demand.

Touch protector 100 includes a ridge 117 that extends along opposing sides of the bridge portion 105. In some embodiments, ridge 117 also extends along the edges of the first backing member 109 and the second backing member 113 that define openings for the first space 111 and the second space 115. In some embodiments, ridge 117 is continuous along opposing sides of the bridge portion 105, along portions of the first base portion 101 and second base portion 103 and along the edges of the first backing member 109 and the second backing member 113 that define openings for the first space 111 and the second space 115. In some embodiments, ridge 117 is along opposing sides of the bridge portion 105 and the edges of the first backing member 109 and the second backing member 113 that define openings for the first space 111 and the second space 115, with the first base portion 101 and second base portion 103 being free from having the ridge 117 such that the ridge 117 is discontinuous between the bridge portion 105 and the first backing member 109 and the second backing member 113. In some embodiments, a discontinuous ridge 117 comprises a first ridge portion along first backing member 109, a second ridge portion along second backing member 113, and third ridge portions along the sides of bridge portion 105.

The ridge 117 has a thickness that is greater than the fourth thickness of the first backing member 109 and the fifth thickness of the second backing member 113. In some embodiments, a thickness of ridge 117 is uniform throughout an entirety of the ridge 117. In some embodiments, the thickness of the ridge 117 is varies among different locations of the ridge 117. In some embodiments, the thickness of ridge 117 is greater than the third thickness of the bridge portion 105.

In some embodiments, the touch protector 100 is free from including the ridge 117. In some embodiments, touch protector 100 is free from including the ridge 117 on the bridge portion. In some embodiments, touch protector 100 includes ridge 117 on one or more of the first backing member 109 or the bridge portion 105, and the second backing member 113 is free from having ridge 117. In some embodiments, ridge 117 adds structural support to one or more of the first backing member 109 or the second backing member 113 to cause one or more of the first space 111 or the second space 115 to always be at least partially open when the touch protector 100 is hanging from a user's belt, bag, purse, briefcase, backpack, belt buckle, belt loop, pant leg, pocket, shirt, jacket, armband or other suitable location accessible to a user.

In some embodiments, ridge 117 adds structural support to the bridge portion 105 to maintain a minimum curvature having a predetermined radius of the fifth surface 105*a* of the bridge portion 105 if the first base portion 101 is over the second base portion 103, the second base portion 103 is over the first base portion 101, and/or the bridge portion 105 is over the first base portion 101 and the second base portion 103.

In some embodiments, the first base portion 101, second base portion 103, bridge portion 105, first backing member 109 and second backing member 113 are a monolithic structure forming the touch protector 100. In some embodiments, the first base portion 101, second base portion 103, bridge portion 105, first backing member 109 and second backing member 113 are a monolithic structure formed by a molding process such that the first base portion 101, second base portion 103, bridge portion 105, first backing member 109 and second backing member 113 are formed by a continuous material. In some embodiments, the first base portion 101, second base portion 103, bridge portion 105, first backing member 109 and second backing member 113 are a monolithic structure formed by a 3-D printing process such that the first base portion 101, second base portion 103, bridge portion 105, first backing member 109 and second backing member 113 are formed by a continuous material.

In some embodiments, the first base portion 101, second base portion 103, and bridge portion 105, are a monolithic structure and at least one of the first backing member 109 or the second backing member 113 is attached to the monolithic structure. In some embodiments, the first base portion 101, second base portion 103, and bridge portion 105 are a monolithic structure formed by a molding process such that the first base portion 101, second base portion 103, and bridge portion 105, are formed by a continuous material, and at least one of the first backing member 109 or the second backing member 113 is attached to the monolithic structure. In some embodiments, the first base portion 101, second base portion 103, and bridge portion 105 are a monolithic structure formed by a 3-D printing process such that the first base portion 101, second base portion 103, and bridge portion 105, are formed by a continuous material, and at least one of the first backing member 109 or the second backing member 113 is attached to the monolithic structure.

In some embodiments, the first base portion 101, second base portion 103, bridge portion 105, first backing member 109 and second backing member 113 are separate components that are attached to one another to form the touch protector 100. In some embodiments, at least two of the first base portion 101, second base portion 103, bridge portion 105, first backing member 109 and second backing member 113 a monolithic structure formed by a continuous material. In some embodiments, at least two of the first base portion 101, second base portion 103, bridge portion 105, first backing member 109 and second backing member 113 are joined together so as to be fixed to one another by way of an adhesive, fastener, stitching, one or more magnets, a hook and loop fastener, or other suitable joint.

In some embodiments, the first base portion 101, second base portion 103, bridge portion 105, first backing member 109 and second backing member 113 are separate components that are removably attached to one another to form the touch protector 100 and facilitate easy cleaning of each separate component. In some embodiments, first backing member 109 and second backing member 113 are removably attached to the first base portion 101 and the second base portion 103 to facilitate easy cleaning of each separable component.

Tether 107 is configured to be extendable such that an end of the tether 107 connected to, or directly or indirectly coupled with, the first base portion 101, the second base portion 103 or the bridge portion 105 is movable between a minimum extension position and a maximum extension position. In some embodiments, tether 107 comprises one or more of a wind-up extendable and retractable cord, a reel and cord assembly, a coiled expandable and retractable cord, or an elastic material. In some embodiments, tether 107 comprises one or more of a cord, string, wire, rope, chain, or other suitable linkage. In some embodiments, touch protector 100 is free from including tether 107. In some embodiments, tether 107 is removably connected to, or directly or indirectly coupled with, the first base portion 101, the second base portion 103, the bridge portion 105, first backing member 109 or second backing member 113 by way of a clip, loop, button, magnet, hook and loop fastener, or other suitable fastener. In some embodiments, one or more of bridge portion 105, first base portion 101, second base portion 103, backing member 109 or second backing member 113 includes one or more holes 119 that are configured to receive a clip, loop, button, magnet, hook and loop fastener, or other suitable fastener to affix the tether 107 or some other suitable attachable accessory to the touch protector 100. In some embodiments, tether 107 comprises a clip, loop, button or other suitable fastener on an end of tether 107 for fixing or attaching the tether 107 to an object such as a user's belt, bag, purse, briefcase, backpack, belt buckle, belt loop, pant leg, pocket, shirt, jacket, armband, or other suitable location accessible to a user.

In some embodiments, tether 107 is configured to apply a first force in a first direction with respect to a connection location or a coupling location with the first base portion 101, the second base portion 103, the bridge portion 105, the first backing member 109 or the second backing member 113 such that an extension of the tether 107 in a second direction opposite to the first direction caused by a second force exerted onto at least one of the first base portion 101, the second base portion 103, the bridge portion 105, the first backing member 109 or the second backing member 113 is prevented until a predetermined threshold is reached.

Tether 107 is configured to allow the end of the tether 107 connected to, or directly or indirectly coupled with, the first base portion 101, the second base portion 103, the bridge portion 105, the first backing member 109 or the second backing member 113 to move away from the minimum extension position toward the maximum extension position if the second force is greater than the predetermined threshold. In some embodiments, the predetermined threshold is equal to or greater than an amount of force exerted on the first base portion 101, the second base portion 103, the bridge portion 105, the first backing member 109 or the second backing member 113 when an object such as a user's thumb or one or more fingers is inserted into at least one of the first space 111 or the second space 115, and the first base portion 101, the second base portion 103, the bridge portion 105, the first backing member 109 and the second backing member 113 are hung from the tether 107.

Hanging the touch protector 100 from a user's belt, bag, purse, briefcase, backpack, belt buckle, belt loop, pant leg, pocket, shirt, jacket, armband or other suitable location accessible to a user makes it possible to improve the readiness of the touch protector 100 for use while preventing inadvertent touching of the touch protector with an unprotected hand or item within a user's bag, for example, and avoiding fumbling to find the touch protector 100 when the user immediately needs to use the touch protector 100. In some embodiments, touch protector 100 has a magnet, clip, hook and loop fastener, or other suitable fastener, in addition to or in lieu of tether 107, configured to removably attach the touch protector 100 to a user's belt, bag, purse, briefcase, backpack, belt buckle, belt loop, pant leg, pocket, shirt, jacket, armband or other suitable location accessible to a user.

In a non-limiting example use case, in accordance with one or more embodiments, touch protector 100 is configured to be hung from a user's belt by way of tether 107. While hanging, and without the user having inserted any fingers or thumb into the first space 111 or the second space 115, the structure comprising the first body portion 101, second body portion 103, bridge portion 105, first backing member 109 and second backing member 113 is in a folded state in which the first surface 101*a* of the first body portion 101 is facing the third surface 103*a* of the second body portion 103, with the bridge portion 105 acting as a hinge such that the first body portion 101, second body portion 103, bridge portion 105 form a substantially U-shaped structure in a side view. In some embodiments, the first body portion 101, second body portion 103, bridge portion 105 are completely folded such that the U-shaped structure is more V-shaped or no space exists between the first body portion 101, second body portion 103, and/or bridge portion 105.

In this example use case, the first space 111 and the second space 115 are facing up and away from the ground such that the first collapsible pocket and the second collapsible pocket are ready to receive the user's finger(s) and/or thumb. In some embodiments, touch protector 100 is capable of receiving the user's finger(s) and/or thumb without requiring the user to use an unprotected hand to put on the touch protector 100. After inserting the user's fingers(s) and/or thumb into the touch protector 100, the user is able to touch and/or grab a doorknob or object, for example, while avoiding direct skin contact with the doorknob or object. The user is then able to remove the finger(s) and/or thumb from the touch protector 100 and the allow the touch protector 100 to hang from the tether 107 so that the structure comprising the first body portion 101, second body portion 103, bridge portion 105, first backing member 109 and second backing member 113 returns to the folded state.

The structure comprising the first body portion 101, second body portion 103, bridge portion 105, first backing member 109 and second backing member 113 being in the folded state helps to reduce a profile and/or general bulkiness of the touch protector 100 so that the touch protector 100 is more convenient and easy to use and less noticeable or less awkward to have hanging from a user's belt, bag, purse, briefcase, backpack, belt buckle, belt loop, pant leg, pocket, shirt, jacket, armband or other suitable location accessible to a user. With or without the tether 107, touch protector 100 is a readily-accessible, easy to use, easy to clean and sanitize apparatus that is a regularly usable in a daily basis.

Touch protector 100 includes an optional stylus 121 coupled with tether 107. In some embodiments, touch protector 100 is free from having stylus 121. In some embodiments, one or more of the first base portion 101, second base portion 103, bridge portion 105, first backing member 109 or second backing member 113 comprises a hole configured to receive stylus 121 for storage. In some embodiments, stylus 121 is independent from tether 107 and one or more of the first base portion 101, second base portion 103, bridge portion 105, first backing member 109 or second backing member 113 is configured to store the stylus 121 when the stylus 121 is not in use. In some embodiments, stylus 121 is independent from tether 107 and is coupled with a separate stylus tether that is coupled with, or capable of being directly or indirectly coupled with, one or more of the first base portion 101, second base portion 103, bridge portion 105, first backing member 109 or second backing member 113. In some embodiments, a stylus tether comprises a retractor that makes it possible to extend and retract the stylus 121 so that the stylus 121 is readily accessible and easily grasped by a user wearing touch protector 100. In some embodiments, stylus tether 123 is similar to tether 107.

Stylus 121 is a utensil that is able to be grabbed by a user, while wearing the touch protector 100 to enable a user to interact with a touch pad, touch screen, or button, for example, without physically touching the touch pad, touch screen or button with the user's own skin. In some embodiments, stylus 121 comprises one or more of a polymer, a metal material, wood, glass, ceramic, some other suitable material, or combination thereof. In some embodiments, stylus 121 comprises a shaft and a tip that each comprise at least one different material.

In some embodiments, the stylus 121 is removably attached to tether 107 so that a longer or shorter stylus 121 can be included in touch protector 100. In some embodiments, stylus 121 is a telescoping stylus. In some embodiments, stylus 121 is configured to be made longer or shorter by way of a sliding mechanism that causes the stylus 121 to expand or contract. In some embodiments, stylus 121 is configured to be made longer or shorter by way of a clicking/spring/detent mechanism that causes the stylus 121 to expand or contract. In some embodiments, stylus 121 is modular such that additional portions of the stylus 121 may be added to the stylus 121 to make stylus 121 longer and portions of the stylus 121 may be removed from the stylus 121 to make the stylus 121 shorter. In some embodiments, stylus 121 is configured to be made longer or shorter by way of some other suitable manner that causes the stylus 121 to expand or contract.

In some embodiments, tether 107 comprises a single retractor reel. In some embodiments, tether 107 is a dual retractor-type that comprises a multiple retractor reels that makes it possible to separately extend and retract both of the mitt-like portion of the touch protector 100 and the stylus 121 individually so that the stylus 121 is readily accessible and easily grasped by a user wearing touch protector 100. In some embodiments, a dual retractor-type tether 107 include reels that are arranged side-by-side. In some embodiments, a dual retractor-type tether 107 include reels that are overlapping such that an axis of rotation about which each of the reels included in the dual retractor are linearly aligned. In some embodiments, a dual retractor-type tether 107 includes reels that are overlapping such that an axis of rotation about which each of the reels included in the dual retractor-type tether 107 are offset. In some embodiments, each reel included in a dual retractor-type tether 107 winds in a clockwise direction. In some embodiments, each reel included in a dual retractor-type tether 107 winds in a counter-clockwise direction. In some embodiments, one reel included in a dual retractor-type tether 107 winds in a clockwise direction and the other reel included in the dual retractor-type tether 107 winds in a counter-clockwise direction.

In some embodiments, a dual retractor-type tether 107 is configured to cause stylus 121 to hang at a position with respect to the structure formed by at least first base portion 101, second base portion 103 and bridge portion 105 such that the stylus 121 can be easily grabbed by a user manipulating the structure formed by at least first base portion 101, second base portion 103 and bridge portion 105. In some embodiments, dual retractor-type tether 107 is configured to cause stylus 121 to hang at a position with respect to the structure formed by at least first base portion 101, second base portion 103 and bridge portion 105 such that the stylus 121 is prevented from entering the first space 111 and/or the second space 115. For example, if a user expects the first space 111 and/or the second space 115 to be untainted from any touching of a potentially contaminated surface, and the tip of the stylus 121 is used to contact a potentially contaminated touch screen, the tip of the stylus 121 is prevented from entering the first space 111 and/or the second space 115 so that any contaminants that could have been transferred to the stylus during use prevented from being inadvertently transferred to the interior surfaces that define first space 111 and/or 115.

In some embodiments, the reel of a dual retractor-type tether 107 with which stylus 121 is coupled is configured to wind a cord to which the stylus 121 is attached such that a portion of the cord to which the stylus 121 is attached exposed from the retractor reel housing is greater than a portion of a cord to which the structure formed by at least first base portion 101, second base portion 103 and bridge portion 105 is attached. In some embodiments, the reel of the dual retractor-type tether 107 with which stylus 121 is coupled is configured to wind a cord to which the stylus 121 is attached such that a portion of the cord to which the stylus 121 is attached exposed from the retractor reel housing is equal to a portion of a cord to which the structure formed by at least first base portion 101, second base portion 103 and bridge portion 105 is attached.

In some embodiments, a linkage by which the stylus 121 is attached to a dual retractor-type tether 107 has a length that is greater than a linkage by which the structure formed by at least first base portion 101, second base portion 103 and bridge portion 105 is attached to the dual retractor-type tether 107 to cause the stylus 121 to hang at a position with respect to the structure formed by at least first base portion 101, second base portion 103 and bridge portion 105 such that the stylus 121 can be easily grabbed by a user manipulating the structure formed by at least first base portion 101, second base portion 103 and bridge portion 105, and/or to prevent the stylus 121 from entering the first space 111 and/or the second space 115.

In some embodiments, stylus 121 has a length that is less than the structure formed by at least first base portion 101, second base portion 103 and bridge portion 105 in the at least partially closed position. In some embodiments, stylus 121 has a length that is equal to the structure formed by at least first base portion 101, second base portion 103 and bridge portion 105 in the at least partially closed position. In some embodiments, stylus 121 has a length that is greater than the structure formed by at least first base portion 101, second base portion 103 and bridge portion 105 in the at least partially closed position.

In some embodiments, the length of the stylus 121 in combination with one or more of the length of cord exposed by the reel of the dual retractor-type tether 107, or the length of the linkage by which the stylus 121 is attached, cause the stylus 121 to hang at a position stylus with respect to the structure formed by at least first base portion 101, second base portion 103 and bridge portion 105 such that the stylus 121 can be easily grabbed by a user manipulating the structure formed by at least first base portion 101, second base portion 103 and bridge portion 105, and/or to prevent the stylus 121 from entering the first space 111 and/or the second space 115.

In some embodiments, one or more of the length of the stylus 121, the length of cord exposed by the reel of the dual retractor-type tether 107, or the length of the linkage by which the stylus 121 is attached, is customizable to cause the stylus 121 to hang at a position stylus with respect to the structure formed by at least first base portion 101, second base portion 103 and bridge portion 105 such that the stylus 121 can be easily grabbed by a user manipulating the structure formed by at least first base portion 101, second base portion 103 and bridge portion 105, and/or to prevent the stylus 121 from entering the first space 111 and/or the second space 115. For example, in some embodiments, the stylus 121 is removably attached to a dual retractor-type tether 107 so that a longer or shorter stylus 121 can be included in touch protector 100.

In some embodiments, stylus 121, or an electrically conductive material used to promote electrical conductivity between a user of touch protector 100 and an object touched by the user by way of touch protector 100, is incorporated into one or more ends 110*a* or 110*b* of first base portion 101, second base portion 103, first backing member 109, and/or second backing member 113. In some embodiments, if stylus 121 or the electrical conductive material is incorporated into one or more ends 110*a* or 110*b* of first base portion 101, second base portion 103, first backing member 109, and/or second backing member 113, the incorporated stylus 121 or electrically conductive material projects away from an outer surface of the structure comprising the first base portion 101, second base portion 103, first backing member 109, and second backing member 113. In some embodiments, if stylus 121 or the electrical conductive material is incorporated into one or more ends 110*a* or 110*b* of first base portion 101, second base portion 103, first backing member 109, and/or second backing member 113, the incorporated stylus 121 or electrically conductive material is integral with an outer surface of the structure comprising the first base portion 101, second base portion 103, first backing member 109, and second backing member 113 such that the outer surface is substantially continuous and free from having a projection extending away from an outer surface of the structure comprising first base portion 101, second base portion 103, first backing member 109, and second backing member 113. In some embodiments, if stylus 121 or the electrical conductive material is incorporated into one or more ends 110*a* or 110*b* of first base portion 101, second base portion 103, first backing member 109, and/or second backing member 113, the incorporated stylus 121 or electrically conductive material is internal to the structure comprising the first base portion 101, second base portion 103, first backing member 109, and second backing member 113.

In some embodiments, touch protector 100 includes a magnet fastener or a hook and look fastener to facilitate coupling of the touch protector 100 with another touch protector 100 such that the two touch protector 100's are capable of being coupled together as a separable pair.

Figure 2:
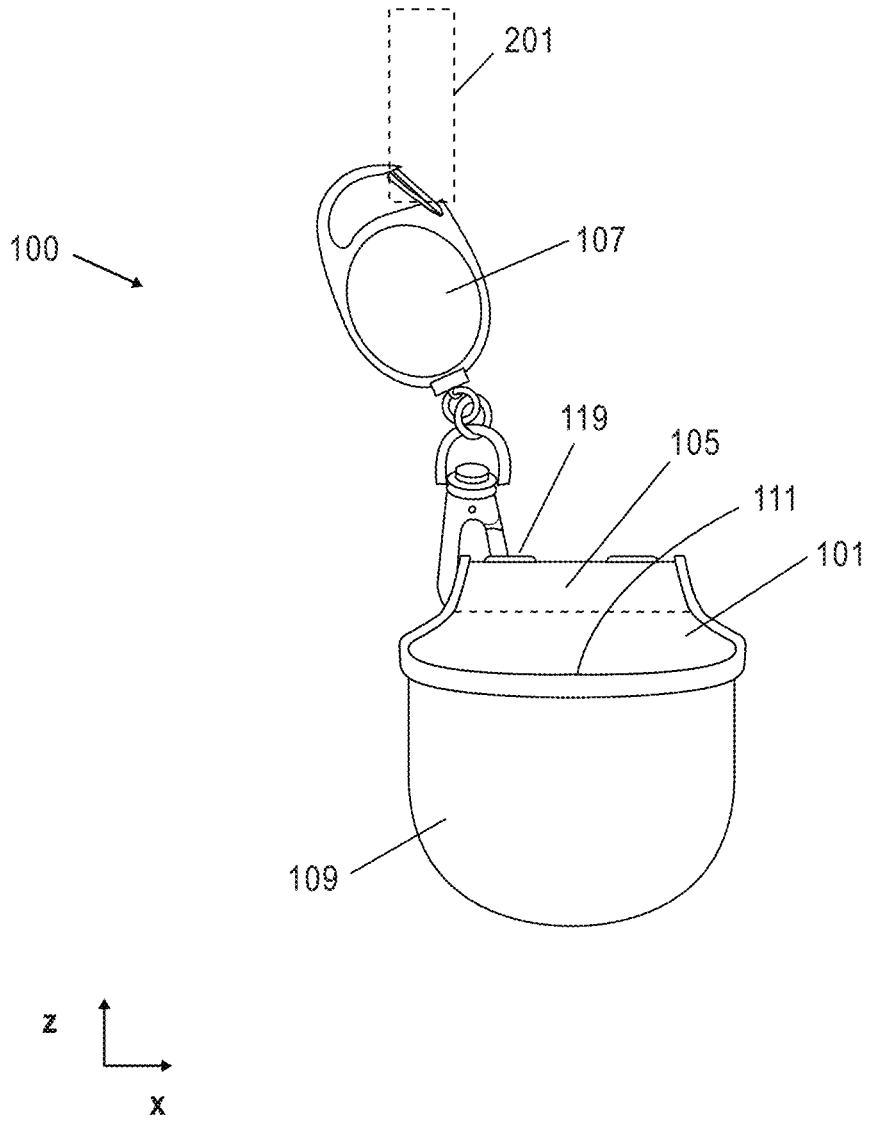
FIG. 2 is a side view of the touch protector in an at least partially closed position, in accordance with one or more embodiments.

FIG. 2 is a side view of touch protector 100 in an at least partially closed position, in accordance with one or more embodiments. Touch protector 100 is hanging from a fixed object 201, such as belt loop or other suitable object. The bridge portion 105 is over the first base portion 101 and the second base portion 103 such that the touch protector 100 is in the at least partially closed position with the first base portion 101 and the second base portion 103 (FIG. 1) hanging downward while the first space 111 and the second space 115 (FIG. 1) are in an at least partially open state.

In the at least partially closed position, the first base portion 101 overlaps the second base portion 103. In some embodiments, an edge of the base portion 105 defining the hole 119 has ridge surrounding the hole 119. The ridge has a thickness greater than the base portion 105. In some embodiments, a hole 119 located elsewhere on the touch protector 100 is optionally defined by an edge of the first base portion 101, second base portion 103, first backing member 109 or second backing member 115 having a thickness greater than the corresponding first base portion 101, second base portion 103, first backing member 109 or second backing member 115. For simplicity, optional stylus 121 (FIG. 1) is not shown in FIG. 2.

Figure 3:
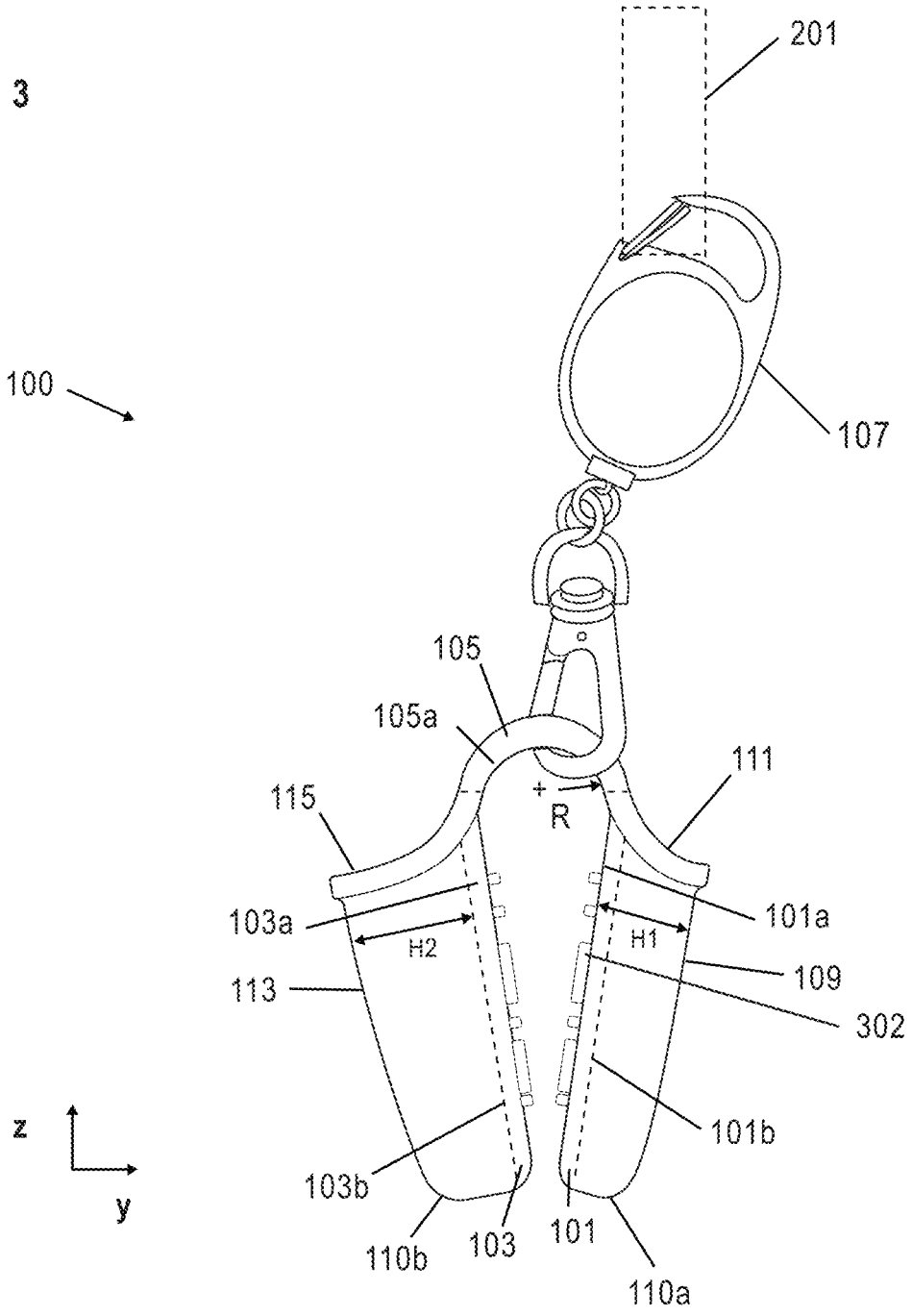
FIG. 3 is a side view of the touch protector in an at least partially closed position, in accordance with one or more embodiments.

FIG. 3 is a side view of touch protector 100 in an at least partially closed position, in accordance with one or more embodiments. Touch protector 100 is hanging from fixed object 201, such as belt loop or other suitable object. The bridge portion 105 is over the first base portion 101 and the second base portion 103 such that the touch protector 100 is in the at least partially closed position with the first base portion 101 and the second base portion 103 hanging downward while the first space 111 and the second space 115 are in an at least partially open state.

In the at least partially closed position, the first base portion 101 overlaps the second base portion 103 such that the first base portion 101, the second base portion 103 and the bridge portion 105 form a substantially U-shaped structure. Touch protector 100 has texturing protrusions 302 extending from the first surface 101*a* of first base portion 101 and the third surface 103*a* of second base portion 103. In some embodiments, touch protector 100 is free from having texturing protrusions 302. For simplicity, optional stylus 121 (FIG. 1) is not shown in FIG. 3.

Bridge portion 105 is curved such that the fifth surface 105*a* of the bridge portion 105 has a radius R about a center axis. In some embodiments, the thickness of the bridge portion 105 causes the fifth surface 105*a* of the bridge portion 105 to maintain the radius R in the at least partially closed position so that the first surface 101*a* of the first base portion 101 and the third surface 103*a* of the second base portion 103 adjoining the fifth surface 105*a* of base portion 105 face one another to form the substantial U-shape in the at least partially closed position. In some embodiments, the thickness of the bridge portion 105 causes the fifth surface 105*a* of the bridge portion 105 to maintain the radius R in the at least partially closed position and cause the first surface 101*a* of the first base portion 101 and the third surface 103*a* of the second base portion 103 adjoining the fifth surface 105*a* of base portion 105 to be angled with respect to one another. In some embodiments, the thickness of the bridge portion 105 causes the fifth surface 105*a* of the bridge portion 105 to maintain the radius R in the at least partially closed position so that the first base portion 101 is separated from the second base portion 103 so that the first base portion 101 is free from direct physical contact with the second base portion 103 while the touch protector 100 is hanging under its own weight.

In some embodiments, one or more of the material, thickness, and radius R of the bridge portion 105 causes the bridge portion 105 to have a spring-like effect that causes the first base portion 101, the second base portion 103 and the bridge portion 105 to maintain a separation between the first base portion 101 and the second base portion 103 unless the first base portion 101 and the second base portion are acted upon by an external force such as by a squeezing of the first base portion 101 and the second base portion 103 together.

The end 110*a* of the structure formed by the first base portion 101 and the first backing member 109 and the end 110*b* of the structure formed by the second base portion 103 and the second backing member 113 are squared off in a side view. In some embodiments, the squared off ends 110*a*, 110*b*, if the inside of the first space 111 and second space 115 have the same or a similar shape at the ends 110*a* and 110*b*, assist a user with inserting a thumb and/or one or more fingers into the first space 111 and the second space 115 while avoiding the first backing member 109 and/or the second backing member 113 from actively pushing a user's thumb and/or fingers out of the touch protector 100 despite the ends 110*a* and 110*b* being curved in a top-side view (e.g., FIG. 1) so as to better match a natural variation between a user's finger lengths. In some embodiments, the curvature in the top-side view, coupled with the squared off ends in the side view, allows for each inserted fingertip to contact an internal sidewall of the first space 111 or the second space 115 on at the end 110*a* or 110*b*.

In some embodiments, the first backing member 109 and the second backing member 113 have rounded ends in a side view. In some embodiments, one of the first backing member 109 or second backing member 113 has a rounded end and the other of the first backing member 109 and the second backing member 113 has a squared-off end.

As discussed above, in some embodiments, the length L1 of the first base portion 101 is equal to the length L2 of the second base portion 103, the width W1 of the first base portion 101 is equal to the width W2 of the second base portion 103, the length L4 of the first backing member 109 is equal to the length L5 of the second backing member 113, and the width W4 of the first backing member 109 is equal to the width W5 of the second backing member 113, wherein a maximum distance between an outer surface of the first backing member 109 and the second surface 101*b* of the first base portion 101 in a third direction perpendicular to the first direction and perpendicular to the second direction is less than a maximum distance between the outer surface of the second backing member 113 and the fourth surface 103*b* of the second base portion 103 in the third direction. FIG. 3 shows a first height H1 of the first backing member 109 with respect to the first base portion 101 is less than a second height H2 of the second backing member 113 with respect to the second base portion 103 such that a maximum distance between the outer surface of the first backing member 109 and the second surface 101*b* of the first base portion 101 is less than a maximum distance between the outer surface of the second backing member 113 and the fourth surface 103*b* of the second base portion 103 in the third direction. As a result, an interior height of the first space 111 is less than an interior height of the second space 115 and the first space 111 is smaller than the second space 115 to facilitate a snug fitting of a user's thumb inserted into the first space 111.

In some embodiments, multiple holes 119 such as that shown in FIG. 1 makes it possible to customize how a user prefers the touch protector 100 to hang from fixed object 201, for example. For example, if the touch protector 100 is of the type that has differently-sized first space 111 and second space 115, a right-handed user may prefer to have the tether 107 attached to a location of touch protector 100 that makes usage of the touch protector 100 easier for the user's right thumb and right fingers to be inserted into first space 111 and second space 115, or a left-handed user may prefer to have the tether 107 attached to a location of touch protector 100 that makes usage of the touch protector 100 easier for the user's left thumb and left fingers to be inserted into first space 111 or second space 115.

Figure 4:
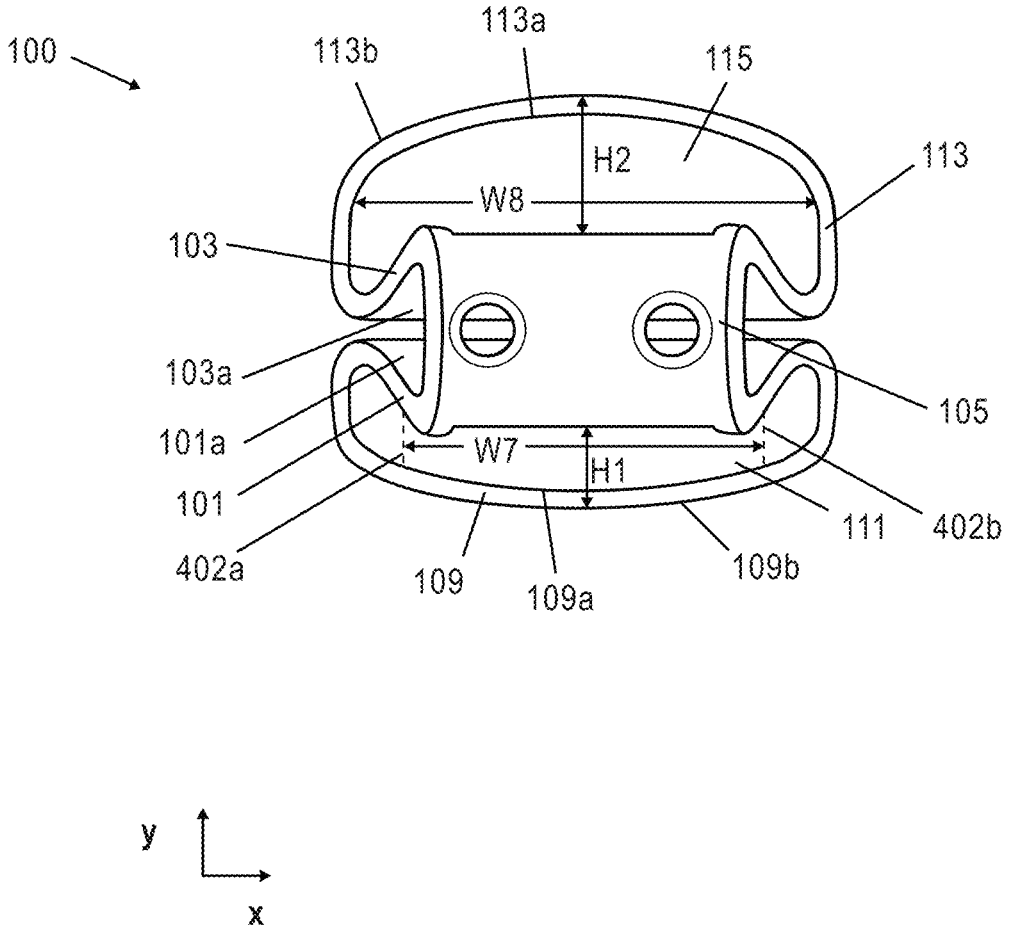
FIG. 4 is a top-side view of the touch protector in an at least partially closed position, in accordance with one or more embodiments.

FIG. 4 is a top-side view of the touch protector 100 in an at least partially closed position, in accordance with one or more embodiments. The bridge portion 105 is over the first base portion 101 and the second base portion 103 such that the touch protector 100 is in the at least partially closed position with the first surface 101*a* of the first base portion 101 facing the second surface 103*a* of the second base portion 103 while the first space 111 and the second space 115 are in an at least partially open state. Touch protector 100 in FIG. 4 is shown free from having optional tether 107 (FIG. 1) and optional stylus 121 (FIG. 1) for simplicity.

First backing member 109 has a seventh surface 109*a* on a first space 111 side of the first backing member 109 and an eighth surface 109*b* opposite the seventh surface 109*a*. Second backing member 113 has a ninth surface 113*a* on a second space 115 side of the second backing member 113 and tenth surface 113*b* opposite the ninth surface 113*a*. In some embodiments, the first backing member 109 and the second backing member 113 are crowned in the at least partially closed position such that the opening of each of the first space 111 and the second space 115 is maximized at a center of the width of each of the first base portion 101 and the second base portion 103 to facilitate easy finger or thumb insertion. In some embodiments, one or more of the first backing member 109 or the second backing member 113 is uncrowned so that the an interior height of the opening of one or more of the first space 111 or the second space 115 is uniform across a width of the opening.

In some embodiments, touch protector 100 has a first base portion 101 and a first backing member 113 that have external lengths and widths that are identical to the second base portion 103 and the second backing member 113, and internally has a first space 111 defined by the second surface 101*b* and the eighth surface 109*a* having corresponding lengths L1/L4 and widths W1/W4 that are less than the lengths L2/L5 and widths W2/W5 of the second base portion 103 and second backing member 113.

In some embodiments, touch protector 100 has a first base portion 101 and a first backing member 113 that have external lengths and widths that are identical to the second base portion 103 and the second backing member 113, and internally has a first space 111 defined by the second surface 101*b* and the eighth surface 109*a* having corresponding lengths L1/L4 and widths W1/W4 that are less than the lengths L2/L5 and widths W2/W5 of the second base portion 103 and second backing member 113 such that the interior of the first space 111 is configured to snuggly accommodate a user's thumb.

In some embodiments, if the interior of the first space 111 is configured to snuggly accommodate a user's thumb, while the exterior lengths and widths of the first base portion 101 and the first backing member 109 are equal to the lengths L2/L5 and widths W2/W5 of the second base portion 103 and second backing member 113, an interior sidewall of the first backing member 109 is separated from an exterior of the first backing member 109 by a distance greater than a thickness of a majority of the first backing member 103. In some embodiments, the separation is filled with extra material, a solid filler of extra material, one or more ribs, one or more additional sidewalls internal to the first backing member 109, or some other suitable structure to fill a void within the structure formed by first base portion 101 and first backing member 109 to facilitate a snug fitting of a user's thumb within first space 111.

For example, in some embodiments, the first height H1 of the first backing member 109 with respect to the first base portion 101 is less than the second height H2 of the second backing member 113 with respect to the second base portion 103 such that a maximum distance between an outer surface of the first backing member 109 and the second surface 101*b* of the first base portion 101 is less than the maximum distance between an outer surface of the second backing member 113 and the fourth surface 103*b* of the second base portion 103. Additionally, in some embodiments, first backing member 109 includes optional structures 402*a* and 402*b* on opposing sides of the first space 111 such that an interior sidewall of the first backing member 109 is separated from an exterior of the first backing member 109 by a distance greater than a first backing member thickness of a majority of the first backing member to facilitate a snug fitting of a user's thumb within first space 111. In some embodiments, a first optional support structure 402*a* extends along a first side of the first base portion 101 and a second optional support structure extends along a second side of the first base portion 101 opposite the first side of the first base portion 101. The first support structure 402*a* and the second support structure 402*b* are portions of the first backing member 109 having thicknesses in the second direction greater than the first backing member thickness of the majority of the first backing member 109 such that an interior width W7 of the first space 111 is less than an interior width W8 of the second space 115 in the second direction.

Figure 5:
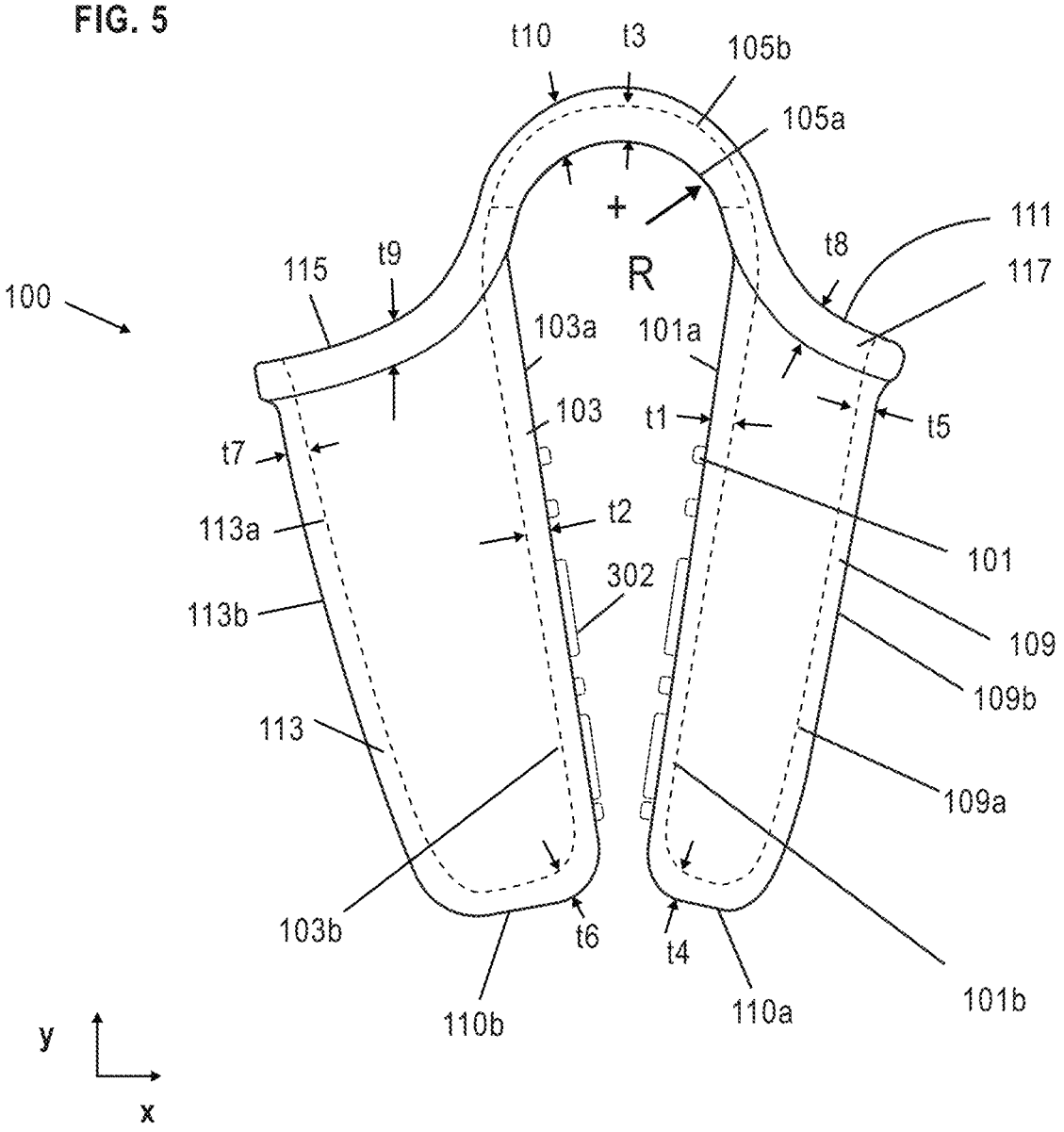
FIG. 5 is a side view of the touch protector in an at least partially closed position, in accordance with one or more embodiments.

FIG. 5 is a side view of the touch protector 100 in an at least partially closed position, in accordance with one or more embodiments. The bridge portion 105 is over the first base portion 101 and the second base portion 103 such that the touch protector 100 is in the at least partially closed position with the first base portion 101 and the second base portion 103 having surfaces facing each other while the first space 111 and the second space 115 are in an at least partially open state. In FIG. 5, touch protector 100 has texturing protrusions 302 extending from the first surface 101*a* of first base portion 101 and the third surface 103*a* of second base portion 103. Touch protector 100 in FIG. 5 is shown free from having optional tether 107 (FIG. 1) and optional stylus 121 (FIG. 1) for simplicity.

First base portion 101 has a first thickness t1 between first surface 101*a* and second surface 101*b*. The second base portion 103 has a second thickness t2 between third surface 103*a* and fourth surface 103*b*. The bridge portion 105 has a third thickness t3 between fifth surface 105*a* and sixth surface 105*b*. The first backing member 109 has a fourth thickness t4 between seventh surface 109*a* and eight surface 109*b* in a region toward an end of the first base portion 101 opposite the bridge portion 105 where the first base portion 101 and the first backing member 109 meet. The first backing member 109 has a fifth thickness t5 between seventh surface 109*a* and eight surface 109*b* throughout a majority of the first backing member 109. The second backing member 113 has a sixth thickness t6 between the ninth surface 113*a* and the tenth surface 113*b* in a region toward an end of the second base portion 103 opposite the bridge portion 105 where the second base portion 103 and the second backing member 113 meet. The second backing member 113 has a seventh thickness t7 between the ninth surface 113*a* and the tenth surface 113*b* throughout a majority of the second backing member 113.

Ridge 117 has an eighth thickness t8 at an edge of the first backing member 101 defining an opening of the first space 111, ridge 117 has a ninth thickness t9 at an edge of the second backing member 113 defining an opening of the second space 115, and ridge 117 has a tenth thickness t10 along the sides of the bridge portion 105.

In some embodiments, thicknesses t1, t2, t3, t4, t5, t6, and t7 are equal to one another. In some embodiments, at least one of thicknesses t1, t2, t3, t4, t5, t6, and t7 is different from one or more other thicknesses t1, t2, t3, t4, t5, t6, and t7.

In some embodiments, the thicknesses t8, t9 and t10 of the ridge 117 are equal to one another. In some embodiments, at least one of the thicknesses t8, t9 or t10 is different from the other of the thicknesses t8, t9 or t10. In some embodiments, the thickness t10 of the ridge 117 is equal to thickness t3 of the bridge portion 105. In some embodiments, thickness t10 is greater than thickness t3 of the bridge portion 105.

In some embodiments, thicknesses t1, t3, t4 and t6 are equal, and thicknesses t5 and t7 are equal to one another and less than thicknesses t1, t2, t4 and t6, and one or more of thicknesses t3 or t10 is greater than at least thicknesses t1 and t2. In some embodiments, a touch protector 100 that has one or more of thicknesses t3 or t10 that are greater than at least thicknesses t1 and t2, the thicker bridge portion 105 and/or ridge 117 on the sides of the bridge portion 105 causes the predetermined radius R of the fifth surface 105*a* of the bridge portion 105 to be maintained when the touch protector is in the at least partially closed position. In some embodiments, a touch protector that has one or more of thicknesses t1, t2, t4 and t6 are at least two times the thicknesses t5 and t7 has improved durability in the base portions and has a harder end or tip as compared to the areas of first and second backing members 109 and 113 in the t5 and t7 thickness regions.

In some embodiments, thicknesses t1, t2, t4 and t6 are at least two times the thicknesses t5 and t7 and at least one of thicknesses t3 or t10 is at least three times the thicknesses t5 and t7. For example, in some embodiments, if the thicknesses t5 and t7 are 1 mm, thicknesses t1, t2, t4 and t6 are at least 2 mm, and at least one of thicknesses t3 or t10 is at least 3 mm. In some embodiments, thicknesses t8 and t9 of the ridge 117 are greater than one or more of thicknesses t1, t2, t4, t5, t6 and t7, but less than at least one of t3 or t10. In some embodiments, thicknesses t8 and t9 of the ridge 117 are equal to one or more of thicknesses t1, t2, t4 and t6, and greater than thicknesses t5 and t7, but less than at least one of t3 or t10.

In some embodiments, thicknesses t1-t10 have other suitable values or proportional relationships that result in the first base portion 101 contacting the second base portion 103 when the touch protector is in the at least partially closed position, cause first space 111 and second space 115 to be in an open state when the touch protector is in the at least partially closed position, or for supporting some other suitable capability.

In some embodiments, the interior transitions between the first base portion 101 and the first backing member 109, and between the second base portion 103 and the second backing member 113, within the first space 111 and the second space 115 are curved. In some embodiments, the curved transitions between the first base portion 101 and the first backing member 109, and between the second base portion 103 and the second backing member 113 promote efficient and effective cleaning of the touch protector 100 and user comfort. In some embodiments, the curved interior transition at end 110*a* gradually thickens from the fifth thickness t5 to the fourth thickness t4 when the fourth thickness t4 is greater than the fifth thickness t5 as the first backing member 109 approaches the first base portion 101. In some embodiments, the curved interior transition at end 110*b* gradually thickens from the seventh thickness t7 to the sixth thickness t6 when the sixth thickness t6 is greater than the seventh thickness t7 as the second backing member 113 approaches the second base portion 103.

In some embodiments, an interior of the structure formed by the first base portion 101 and the first backing member 109 has a curved surface like that of a backing member that has a uniform thickness and a curved exterior surface in the end region and a distance between the curved interior surface and the end 110*a* is filled with extra material to cause the first backing member 109 to be thicker in the end 110*a* as compared to one or more other areas of the first backing member 109. For example, the first backing member 109 optionally has a thickness t4 in end 110*a* that is greater than the thickness t5 of the majority of the first backing member 101. In some embodiments, the thicker end 110*a* increases a rigidity of the structure formed by the first base portion 101 and the first backing member 113 and preciseness with which a user is able to press against a button, for example, with the user's thumb or finger within the first space 111.

In some embodiments, the first backing member 109 optionally has a thickness t4 in end 110*a* less than the thicknesses of the first support structure 402*a* (FIG. 4) and the second support structure 402*b* (FIG. 4) in the second direction. In some embodiments, a touch protector having thickness t4 in end 110*a* that is less than the thicknesses of the first support structure 402*a* and the second support structure 402*b* in facilitates a snug fit for a user's thumb inserted into first space 111 while increasing a user's ability to feel an object with which the user interacts such as when a user presses against a button, for example, with the user's thumb within the first space 111.

Figure 6:
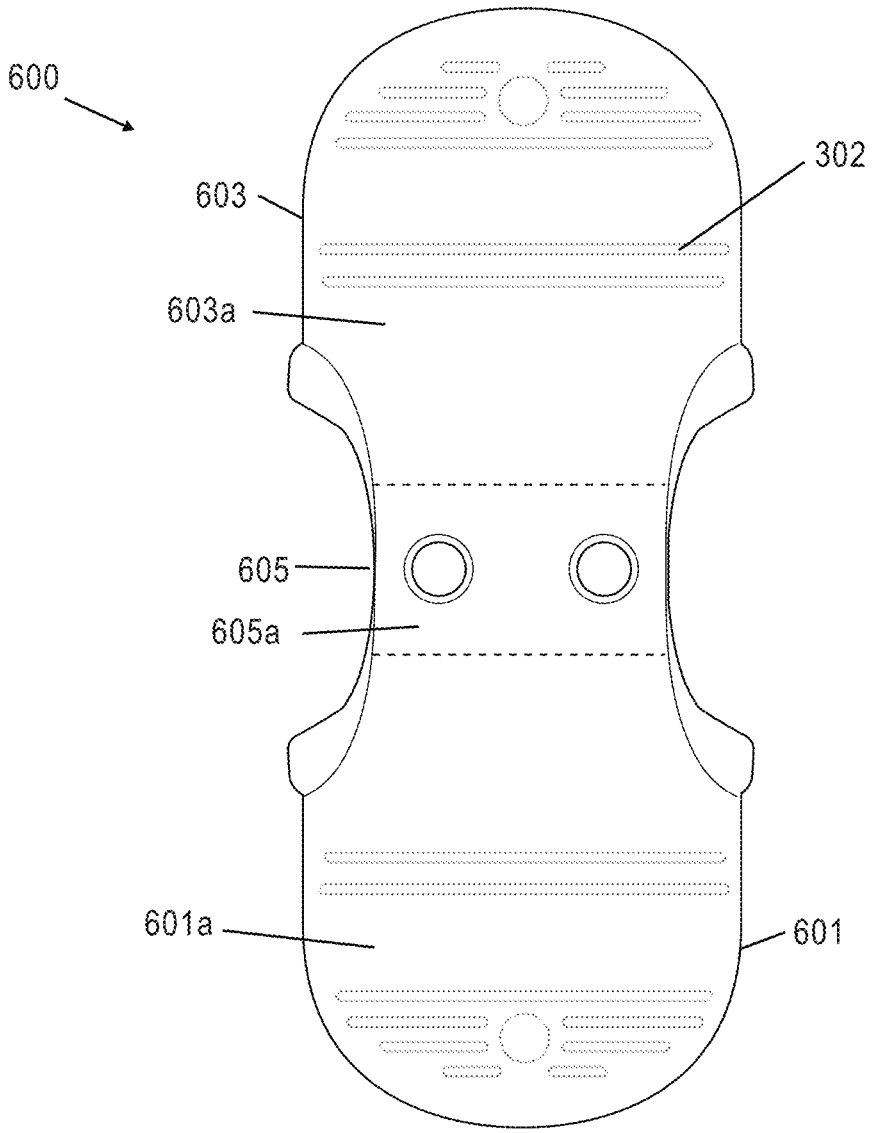
FIG. 6 is a bottom-side view of a touch protector in an open position, in accordance with one or more embodiments.

FIG. 6 is a bottom-side view of touch protector 100 in an open position, in accordance with one or more embodiments. The first base portion 101 and the second base portion 103 have texturing projections 302 extending away from the first surface 101*a* of the first base portion 101 and the third surface 103*a* of the second base portion 103. The fifth surface 105*a* of bridge portion 105 is free from having texturing projections. In some embodiments, the fifth surface 105*a* of the bridge portion 105 has texturing projections. In some embodiments, one or more of the first surface 101*a* of the first base portion 101, the third surface 103*a* of the second base portion 103 or the fifth surface 105*a* of the bridge portion 105 is textured by having a series of indentations or trenches in addition to or in lieu of the texturing projections 302.

Texturing projections 302 are substantially linear. In some embodiments, texturing projections 302 are one or more of linear, curved, circular, pyramidal, cubic, hemispherical, cylindrical, comprise lettering, or have some other suitable shape.

An aspect of this description is related to an apparatus comprising a first base portion having a first surface and a second surface opposite the first surface, a first length extending in a first direction from a first end of the first base portion to a second end of the first base portion opposite the first end of the first base portion, and a first width extending in a second direction different from the first direction. The first width extends from a first side of the first base portion to a second side of the first base portion opposite the first side of the first base portion. The apparatus also comprises a second base portion coupled with the first base portion. The second base portion has a third surface and a fourth surface opposite the third surface, a second length extending in the first direction from a first end of the second base portion to a second end of the second base portion opposite the first end of the second base portion, and a second width extending in the second direction. The second width extends from a first side of the second base portion to a second side of the second base portion opposite the first side of the second base portion.

The apparatus further comprises a first backing member extending from the first side of the first base portion to the second side of the first base portion. The first backing member and the first base portion are configured to have a first space between the first backing member and the first base portion. The apparatus additionally comprises a second backing member extending from the first side of the second base portion to the second side of the second base portion. The second backing member and the second base portion are configured to have a second space between the second backing member and the second base portion, The first length is equal to the second length and the first width is equal to the second width. A maximum distance between an outer surface of the first backing member and the second surface of the first base portion in a third direction perpendicular to the first direction and perpendicular to the second direction is less than a maximum distance between an outer surface of the second backing member and the third surface of the second base portion in the third direction. The first space is smaller than the second space.

Another aspect of this description is related to an apparatus comprising a first base portion having a first surface, a second surface opposite the first surface, a first length extending in a first direction from a first end of the first base portion to a second end of the first base portion opposite the first end of the first base portion, and a first width extending in a second direction different from the first direction. The first width extends from a first side of the first base portion to a second side of the first base portion opposite the first side of the first base portion. The apparatus also comprises a second base portion having a third surface and a fourth surface opposite the third surface, a second length extending in the first direction from a first end of the second base portion to a second end of the second base portion opposite the first end of the second base portion, and a second width extending in the second direction. The second width extends from a first side of the second base portion to a second side of the second base portion opposite the first side of the second base portion.

The apparatus further comprises a first backing member extending from the first side of the first base portion to the second side of the first base portion. The first backing member and the first base portion are configured to have a first space between the first backing member and the first base portion. The apparatus additionally comprises a second backing member extending from the first side of the second base portion to the second side of the second base portion. The second backing member and the second base portion are configured to have a second space between the second backing member and the second base portion. The apparatus also comprises a bridge portion coupling the first base portion and the second base portion, The first length is equal to the second length and the first width is equal to the second width. A maximum distance between an outer surface of the first backing member and the second surface of the first base portion in a third direction perpendicular to the first direction and perpendicular to the second direction is less than a maximum distance between an outer surface of the second backing member and the third surface of the second base portion in the third direction. The first space is smaller than the second space.

Another aspect of this description is related to an apparatus comprising a first base portion, a second base portion, and a bridge portion coupling the first base portion and the second base portion. The apparatus also comprises a first backing member extending from a first side of the first base portion to a second side of the first base portion opposite the first side of the first base portion. The first backing member and the first base portion are configured to have a first space between the first backing member and the first base portion. The apparatus further comprises a second backing member extending from a first side of the second base portion to a second side of the second base portion opposite the first side of the second base portion. The second backing member and the second base portion are configured to have a second space between the second backing member and the second base portion.

A first length and a first width of the first base portion are equal to a second length and a second width of the second base portion. A height of the first backing member with respect to the first base portion is less than a height of the second backing member with respect to the second base portion such that an interior height of the first space is less than an interior height of the second space. The first backing member comprises a first support structure extending along the first side of the first base portion and a second support structure extending along the second side of the first base portion, the first support structure and the second support structure being portions of the first backing member having thicknesses greater than a thickness of a majority of the first backing member and greater than a thickness of the second backing member such that an interior width of the first space is less than an interior width of the second space.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An apparatus, comprising:

a first base portion having a first surface and a second surface opposite the first surface, a first length extending in a first direction from a first end of the first base portion to a second end of the first base portion opposite the first end of the first base portion, and a first width extending in a second direction different from the first direction, the first width extending from a first side of the first base portion to a second side of the first base portion opposite the first side of the first base portion;

a second base portion coupled with the first base portion, the second base portion having a third surface and a fourth surface opposite the third surface, a second length extending in the first direction from a first end of the second base portion to a second end of the second base portion opposite the first end of the second base portion, and a second width extending in the second direction, the second width extending from a first side of the second base portion to a second side of the second base portion opposite the first side of the second base portion;

a first backing member extending from the first side of the first base portion to the second side of the first base portion, the first backing member and the first base portion being configured to have a first space between the first backing member and the first base portion; and a second backing member extending from the first side of the second base portion to the second side of the second base portion, the second backing member and the second base portion being configured to have a second space between the second backing member and the second base portion, wherein the first length is equal to the second length, the first width is equal to the second width, a maximum distance between an outer surface of the first backing member and the second surface of the first base portion in a third direction perpendicular to the first direction and perpendicular to the second direction is less than a maximum distance between an outer surface of the second backing member and the third surface of the second base portion in the third direction, and the first space is smaller than the second space.

2. The apparatus of claim 1, wherein an interior sidewall of the first backing member is separated from an exterior of the first backing member by a distance greater than a first backing member thickness of a majority of the first backing member, and a second backing member thickness of the second backing member is less than the distance by which the interior sidewall of the first backing member is separated from the exterior of the first backing member.

3. The apparatus of claim 2, further comprising:

a first ridge extending along a first edge of the first backing member opposite the first base portion defining a first opening of the first space; and a second ridge extending along a second edge of the second backing member opposite the second base portion defining a second opening of the second space, wherein the first ridge has a first ridge thickness greater than the first backing member thickness, and the second ridge has a second ridge thickness greater than the second backing member thickness.

4. The apparatus of claim 3, wherein the first backing member has an end thickness in the first direction greater than the first backing member thickness of the majority of the first backing member.

5. The apparatus of claim 2, wherein the distance between the interior sidewall of the first backing member and the exterior of the first backing member is filled with a solid material, increasing the first backing member thickness.

6. The apparatus of claim 2, wherein the distance between the interior sidewall of the first backing member and the exterior of the first backing member is filled by one or more ribs increasing the first backing member thickness.

7. The apparatus of claim 2, wherein the first backing member comprises a first support structure extending along the first side of the first base portion and a second support structure extending along the second side of the first base portion, the first support structure and the second support structure being portions of the first backing member having thicknesses in the second direction greater than the first backing member thickness of the majority of the first backing member, and the first backing member has an end thickness in the first direction less than the thicknesses of the first support structure and the second support structure in the second direction.

8. The apparatus of claim 1, wherein the first backing member and the first base portion are configured to form a collapsible pocket such that the first space expands based on a size of an object within the collapsible pocket and retracts based the object being removed from the collapsible pocket.

9. The apparatus of claim 1, wherein the first base portion, the second base portion, the first backing member and the second backing member comprise identical materials.

10. The apparatus of claim 9, wherein the first base portion, the second base portion, the first backing member and the second backing member are a monolithic structure.

11. The apparatus of claim 1, further comprising:

a tether coupled with the first base portion or the second base portion.

12. An apparatus, comprising:

a first base portion having a first surface, a second surface opposite the first surface, a first length extending in a first direction from a first end of the first base portion to a second end of the first base portion opposite the first end of the first base portion, and a first width extending in a second direction different from the first direction, the first width extending from a first side of the first base portion to a second side of the first base portion opposite the first side of the first base portion;

a second base portion having a third surface and a fourth surface opposite the third surface, a second length extending in the first direction from a first end of the second base portion to a second end of the second base portion opposite the first end of the second base portion, and a second width extending in the second direction, the second width extending from a first side of the second base portion to a second side of the second base portion opposite the first side of the second base portion;

a first backing member extending from the first side of the first base portion to the second side of the first base portion, the first backing member and the first base portion being configured to have a first space between the first backing member and the first base portion;

a second backing member extending from the first side of the second base portion to the second side of the second base portion, the second backing member and the second base portion being configured to have a second space between the second backing member and the second base portion; and a bridge portion coupling the first base portion and the second base portion, wherein the first length is equal to the second length, the first width is equal to the second width, a maximum distance between an outer surface of the first backing member and the second surface of the first base portion in a third direction perpendicular to the first direction and perpendicular to the second direction is less than a maximum distance between an outer surface of the second backing member and the third surface of the second base portion in the third direction, and the first space is smaller than the second space.

13. The apparatus of claim 12, wherein the bridge portion has a fifth surface adjoining the first surface and the third surface, a sixth surface opposite the fifth surface adjoining the second surface and the fourth surface, a third length extending in the first direction from a first end of the bridge portion to a second end of the bridge portion opposite the first end of the bridge portion, and a third width extending in the second direction, the third width extending from a first side of the bridge portion to a second side of the bridge portion opposite the first side of the bridge portion, and the first length and the second length are greater than the third length.

14. The apparatus of claim 13, wherein the first width and the second width are greater than the third width.

15. The apparatus of claim 12, wherein the first base portion, the second base portion, the bridge portion, the first backing member and the second backing member are a monolithic structure.

16. The apparatus of claim 15, wherein the first backing member and the first base portion are configured to form a collapsible pocket such that the first space expands based on a size of an object within the collapsible pocket and retracts based the object being removed from the collapsible pocket.

17. The apparatus of claim 12, wherein the first backing member comprises a first support structure extending along the first side of the first base portion and a second support structure extending along the second side of the first base portion, the first support structure and the second support structure being portions of the first backing member having thicknesses in the second direction greater than a first backing member thickness of the majority of the first backing member.

18. The apparatus of claim 17, wherein the first backing member has an end thickness in the first direction less than the thicknesses of the first support structure and the second support structure in the second direction.

19. An apparatus, comprising:

a first base portion;

a second base portion;

a bridge portion coupling the first base portion and the second base portion;

a first backing member extending from a first side of the first base portion to a second side of the first base portion opposite the first side of the first base portion, the first backing member and the first base portion being configured to have a first space between the first backing member and the first base portion; and a second backing member extending from a first side of the second base portion to a second side of the second base portion opposite the first side of the second base portion, the second backing member and the second base portion being configured to have a second space between the second backing member and the second base portion, wherein a first length and a first width of the first base portion are equal to a second length and a second width of the second base portion, a height of the first backing member with respect to the first base portion is less than a height of the second backing member with respect to the second base portion such that an interior height of the first space is less than an interior height of the second space, and the first backing member comprises a first support structure extending along the first side of the first base portion and a second support structure extending along the second side of the first base portion, the first support structure and the second support structure being portions of the first backing member having thicknesses greater than a thickness of a majority of the first backing member and greater than a thickness of the second backing member such that an interior width of the first space is less than an interior width of the second space.

20. The apparatus of claim 19, wherein the first backing member has an end thickness opposite the bridge portion less than the thicknesses of the first support structure and the second support structure.

* * * * *